US008276214B2

(12) United States Patent
Grilliot et al.

(10) Patent No.: US 8,276,214 B2
(45) Date of Patent: Oct. 2, 2012

(54) PROTECTIVE GLOVE

(75) Inventors: William L. Grilliot, West Milton, OH (US); William L. Grilliot, Jr., Dayton, OH (US); Mary I. Grilliot, West Milton, OH (US)

(73) Assignee: Honeywell International Inc., Morristown, NJ (US)

( * ) Notice: Subject to any disclaimer, the term of this patent is extended or adjusted under 35 U.S.C. 154(b) by 316 days.

(21) Appl. No.: 12/407,974

(22) Filed: Mar. 20, 2009

(65) Prior Publication Data

US 2010/0235962 A1 Sep. 23, 2010

(51) Int. Cl.
*A41D 19/00* (2006.01)

(52) U.S. Cl. ..... 2/161.6; 2/161.1; 2/161.2; 2/161.3; 2/163; 2/16

(58) Field of Classification Search ..... 2/161.6, 2/161.1, 161.2, 161.3, 163, 169, 16, 20
See application file for complete search history.

(56) References Cited

U.S. PATENT DOCUMENTS 2,227,586 A * 1/1941 McKemie ..... 2/169
2,316,575 A * 4/1943 Evangelista ..... 2/169
2,343,449 A * 3/1944 Franzl ..... 2/169
2,434,044 A * 1/1948 Levine ..... 2/169
2,732,559 A * 1/1956 Sabin ..... 2/169
2,770,809 A * 11/1956 Howard ..... 2/169
3,760,425 A * 9/1973 Komatsu ..... 2/169
4,001,895 A * 1/1977 Cohen ..... 2/161.6
6,209,138 B1 * 4/2001 Kang ..... 2/167

* cited by examiner

*Primary Examiner* — Alissa Tompkins

(74) *Attorney, Agent, or Firm* — Wood, Phillips, Katz, Clark & Mortimer

(57) ABSTRACT

A protective glove (10) is provided for use by a firefighter or other emergency worker. The glove (10) has a hand covering portion (16) with a plurality of fingers (18) extending therefrom. The protective glove (10) includes a palm face (12) to cover the palm side of the hand and fingers of a wearer, a back face (14) to cover the back side of the hands and fingers of a wearer, and at least one fourcette (22) connecting the palm face (12) to the back face (14) around a perimeter of at least one of the fingers (18) of the glove (10) to define a 3-D type construction for the at least one of the fingers (18). The palm face (12) is joined directly to the back face (14) around a perimeter of at least another one of the fingers (18) of the glove (10) to define a pancake-type construction for the at least another one of the fingers (18).

16 Claims, 1 Drawing Sheet

PROTECTIVE GLOVE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to a protective glove for a firefighter, an emergency worker, or other first responder.

BACKGROUND OF THE INVENTION

Typically, firefighter's and/or other emergency workers wear protective gloves to protect the user's hands from burns, abrasions and other injuries that can occur in hazardous environments. It is desirable that such gloves do not impede the firefighter or other such emergency worker from effectively and/or efficiently using their hands to perform required tasks. Additionally, it is also desirable for such gloves to minimize the fatigue in a user's hand that can be generated over a period of time from working in an emergency or hazardous environment. Furthermore, it is always desirable to minimize the cost of manufacturing such gloves. Accordingly, there is a continuing need to improve such protective gloves.

SUMMARY OF THE INVENTION

In accordance with one feature of the invention, a protective glove is provided for use by a firefighter or other emergency worker, the glove having a hand covering portion with a plurality of fingers extending therefrom. The protective glove includes a palm face to cover the palm side of the hand and fingers of a wearer, a back face to cover the back side of the hand and fingers of a wearer, and at least one fourcette connecting the palm face to the back face around a perimeter of at least one of the fingers of the glove to define a 3-D type construction for the at least another one of the fingers. The palm face is joined directly to the back face around a perimeter of at least another one of the fingers of the glove to define a pancake type construction for the at least one of the fingers.

As one feature, the at least one of the fingers includes a plurality of the fingers.

In one feature, the at least one of the fingers includes a pinkie finger of the glove.

According to one feature, the at least one of the fingers includes a ring finger of the glove.

In one feature, the at least another one of the fingers includes an index finger of the glove.

As one feature, the at least another one of the fingers includes a middle finger of the glove.

According to one feature, the at least another one of the fingers includes a thumb of the glove.

In one feature, the at least one fourcette includes a plurality of fourcettes and the at least another one of the fingers of the glove includes a plurality of the fingers of the glove.

In accordance with one feature of the invention, a protective glove is provided for use by a firefighter or other emergency worker. The protective glove includes palm face to cover the palm side of the hand and fingers of a wearer, a back face to cover the back side of the hand and fingers of a wearer, and at least one fourcette connecting the palm face to the back face in an index finger of the glove to define a 3-D type construction for the index finger. The palm face is joined directly to the back face in a pinkie finger of the glove to define a pancake type construction for the pinkie finger.

In accordance with one feature of the invention, a protective glove is provided for use by a firefighter or other emergency worker. The protective glove includes a palm face to cover the palm side of the hand and fingers of a wearer, a back face to cover the back side of the hand and fingers of a wearer, and at least one fourcette connecting the palm face to the back face in an index finger and middle finger of the glove to define a 3-D type construction for each of the index and middle fingers. The palm face is joined directly to the back face in a pinkie finger and a ring finger of the glove to define a pancake type construction for each of the pinkie and ring fingers. As a further feature, a fourcette connects the palm face to the back face in a thumb of the glove to define a 3-D type construction for the thumb. In yet a further feature, the at least one fourcette is a plurality of fourcettes.

Other objects, features, and advantages of the invention will become apparent from a review of the entire specification, including the appended claims and drawings.

DETAILED DESCRIPTION OF THE PREFERRED EMBODIMENT

Figure 1:
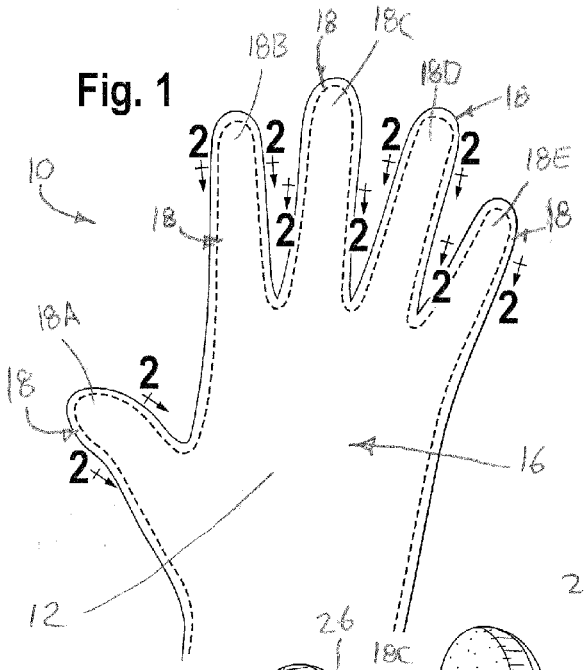
FIG. 1 is a plan view of a protective glove embodying the invention.

As illustrated in FIG. 1 and related views, a protective glove 10 for a firefighter or other emergency worker or responder is shown and includes a palm face 12 that covers the palm side of the hand and fingers of a wearer, and a back face 14 that covers the back side of the hand and fingers of a wearer. The glove 10 may also include a suitable cuff (not shown) of any suitable construction. The glove has a hand covering portion 16 with a plurality of fingers 18 extending therefrom. As illustrated, 18A is a thumb of the glove, 18B is an index finger of the glove, 18C is a middle finger of the glove, 18D is a ring finger of the glove, and 18E is a pinkie finger of the glove.

Figure 2A:
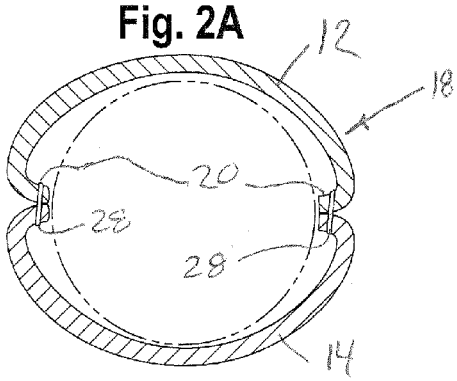
FIG. 2A is an enlarged view taken along any of lines 2-2 in FIG. 1 and showing a construction for at least one of the fingers of the protective gloves.
Figure 2B:
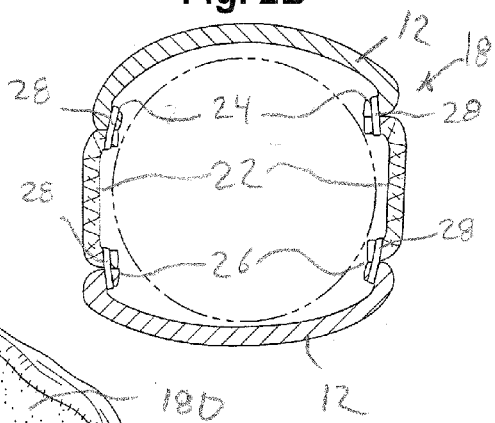
FIG. 2B is an enlarged view taken from any of lines 2-2 in FIG. 1 showing a construction for at least one other finger of the glove of FIG. 1.

The glove 10 utilizes both a 2-D pancake style construction and a 3-D style construction in the fingers 18. More specifically, one or more of the fingers 18 have a pancake type construction such as shown in FIG. 2A wherein the palm face 12 is connected directly to the back face 14 such as at seam 20 that extends around the perimeter of the corresponding finger 18, while at least one or more of the other fingers 18 have a 3-D type construction such as shown in FIG. 2B wherein a fourcette 22 connects the palm face 12 to the back face 14, with seams 24 and 26 extending around the perimeter of the corresponding finger and connecting the fourcette 22 to the palm face 12 and the back face 14, respectively. While a particular seam construction is shown in FIGS. 2A and 2B, any suitable seam construction can be utilized for the seams, with any suitable seam connection technique being used, including, for example, lines of stitching 28, such as shown in FIGS. 2A and 2B.

It will be appreciated that the 3-D type construction shown in FIG. 2B allows for greater flexibility in the fingers 18 of the glove 10 that incorporate this construction, while the 2-D construction shown in FIG. 2A provides less flexibility but helps to minimize the cost of manufacturing those fingers by eliminating a fourcette and the requirement for an additional seam.

Figure 3:
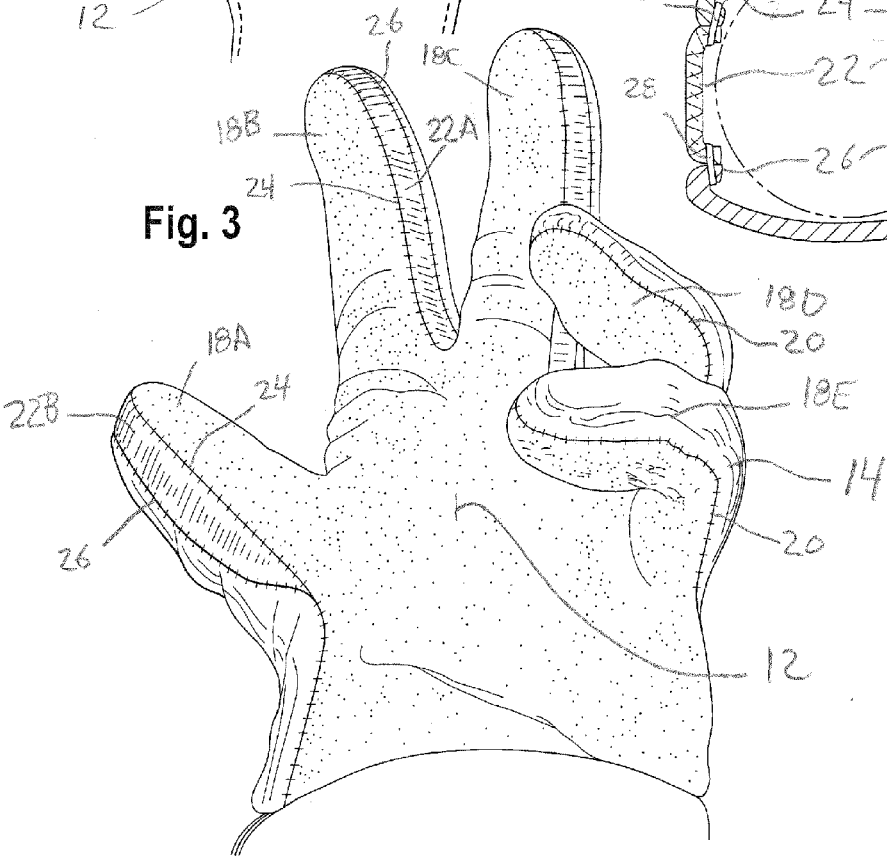
FIG. 3 is a perspective view of one preferred embodiment of a glove embodying the present invention.

FIG. 3 shows one highly preferred embodiment wherein the thumb 18A, index finger 18B and middle finger 18C of the glove 10 have a 3-D construction such as shown in FIG. 2B, with the ring finger 18D and pinkie finger 18E of the glove 10 having the pancake-type construction shown in FIG. 2A. Thus, the palm face 12 is joined at the back face 14 around a tip of at least one of the fingers (ring finger 18D and pinkie finger 18E) of the glove 10 and at least one fourcette (fourcette 22A and fourcette 22B) connects the palm face 12 to the back face 14 around a tip of at least one of the fingers (thumb 18A, index finger 18B and middle finger 18C) of the glove 10. It will be appreciated that in practice, it is typical for the thumb, index finger and middle finger of a firefighter or other emergency rescue worker's hands to require more flexibility and to be relied on more when performing required tasks. It can be seen that in this particular construction, the index and middle fingers 18B and 18C utilize one fourcette 22A that extends around the perimeter of both fingers 18B and 18C, while the thumb 18A utilizes another fourcette 22B that extends around the perimeter of the thumb 18A. Thus, the fourcette 22A connects the palm face 12 to the back face 14 in the index finger 18B and middle finger 18C to define a 3-D type construction for at least a majority of the index finger 18B and middle finger 18C. It should be appreciated that fourcette 22A could have been extended around the thumb 18A to eliminate the fourcette 22B. Similarly, it should be appreciated that individual fourcettes 22 could be utilized for each of the fingers 18A, 18B and 18C.

Typically, the protective glove 10 will have an outer shell 30 and one or more liners, such as a thermal liner, a moisture barrier and/or a moisture/vapor liner. The outer shell 30 can be made from any suitable material, such as from a natural leather, such as elk hide, a synthetic leather, or a suitable fabric, such as Kevlar® fabric or Nomex® fabric. Preferably, the glove 10 will conform to all applicable and current National Fire Protection Association standards.

The invention claimed is:

1. A protective glove for use by a firefighter or other emergency worker, the glove having a hand covering portion with a plurality of fingers extending therefrom, the protective glove comprising:

a palm face to cover a palm side of the hand and fingers of a wearer;

a back face to cover a back side of the hand and fingers of a wearer, the palm face joined directly to the back face around a tip of at least one of the fingers of the glove to define a pancake type construction for the at least one of the fingers; and at least one fourcette connecting the palm face to the back face around a tip of at least another one of the fingers of the glove to define a 3-D type construction for the at least another one of the fingers.

2. The protective glove of claim 1 wherein the at least one of the fingers comprises a plurality of the fingers.

3. The protective glove of claim 1 wherein the at least one of the fingers comprises a pinkie finger of the glove.

4. The protective glove of claim 3 wherein the at least one of the fingers comprises a ring finger of the glove.

5. The protective glove of claim 1 wherein the at least another one of the fingers comprises an index finger of the glove.

6. The protective glove of claim 1 wherein the at least another one of the fingers comprises a middle finger of the glove.

7. The protective glove of claim 1 wherein the at least another one of the fingers comprises a thumb of the glove.

8. The protective glove of claim 1 wherein the at least one fourcette comprises a plurality of fourcettes and the at least another one of the fingers of the glove comprises a plurality of the fingers of the glove.

9. A protective glove for use by a firefighter or other emergency worker, the protective glove comprising:

a palm face to cover a palm side of the hand and fingers of a wearer;

a back face to cover a back side of the hand and fingers of a wearer, the palm face joined directly to the back face in a pinkie finger of the glove to define a pancake type construction for the pinkie finger; and at least one fourcette connecting the palm face to the back face in an index finger of the glove to define a 3-D type construction for at least a majority of the index finger.

10. The protective glove of claim 9 wherein the palm face is joined directly to the back face in a ring finger of the glove to define a pancake type construction for the ring finger.

11. The protective glove of claim 9 wherein the at least one fourcette connects the palm face to the back face in a middle finger of the glove to define a 3-D type construction for the middle finger of the glove.

12. The protective glove of claim 9 wherein the at least one fourcette connects the palm face to the back face in a thumb of the glove to define a 3-D type construction for the thumb.

13. The protective glove of claim 12 wherein the at least one fourcette comprises a plurality of fourcettes.

14. A protective glove for use by a firefighter or other emergency worker, the protective glove comprising:

a palm face to cover a palm side of the hand and fingers of a wearer;

a back face to cover a back side of the hand and fingers of a wearer, the palm face joined directly to the back face in a pinkie finger and a ring finger of the glove to define a pancake type construction for each of the pinkie and ring fingers; and at least one fourcette connecting the palm face to the back face in at least a majority of an index finger and a middle finger of the glove to define a 3-D type construction for each of the index and middle fingers.

15. The protective glove of claim 14 wherein a fourcette connects the palm face to the back face in a thumb of the glove to define a 3-D type construction for the thumb.

16. The protective glove of claim 14 wherein the at least one fourcette is a plurality of fourcettes.

* * * * *